US005454657A

United States Patent [19]

Kim

[11] Patent Number: 5,454,657

[45] Date of Patent: Oct. 3, 1995

[54] COMBINED LIGHTER PEN

[76] Inventor: Jong-Il Kim, #94-1 Suyu 1-dong, Tobong-gu, Seoul, Rep. of Korea

[21] Appl. No.: 204,888

[22] Filed: Mar. 2, 1994

Related U.S. Application Data

[63] Continuation of Ser. No. 91,562, Jul. 15, 1993, abandoned.

[30] Foreign Application Priority Data

Jul. 24, 1992 [KR] Rep. of Korea ..... UM92-13717

[51] Int. Cl.[6] ..... B43K 29/16

[52] U.S. Cl. ..... 401/195; 431/253

[58] Field of Search ..... 401/195; 431/253

[56] References Cited

U.S. PATENT DOCUMENTS 2,308,225 1/1943 Edenburg ..... 431/253 X
4,384,799 5/1983 Shklousky ..... 401/195

FOREIGN PATENT DOCUMENTS 981486 5/1951 France ..... 401/195
2358994 2/1978 France ..... 401/195
1962749 6/1971 Germany ..... 401/195

*Primary Examiner*—Steven A. Bratlie
*Attorney, Agent, or Firm*—Birch, Stewart, Kolasch & Birch

[57] ABSTRACT

A combined lighter and pen includes a pen part and a lighter part detachably combined with each other. The pen part has an internally threaded top section. The lighter part includes a gas container provided at its upper end with an ignition device as well as a gas nozzle, and at its lower end with an externally threaded engagement section detachably engageable with the threaded top section of the pen part. The gas container is slidably received by a hollow outer casing which engages with an internally threaded upper cap. The upper cap is provided with a removable metal net which is heated by a flame projected from the gas nozzle. The lighter is operated by an operating piece movably received by a side opening of the outer casing such that its pressing part rests on a side section of the nozzle control piece and comes into close contact with a top end of the ignition switch of the ignition device. When pressed down, the operating piece presses down the nozzle control piece as well as the ignition switch. The operating piece is supported by a clip such that it is positioned in a place in the side opening of the outer casing.

7 Claims, 2 Drawing Sheets

COMBINED LIGHTER PEN

This application is a continuation, of application Ser. No. 08/091,562 filed on Jul. 15, 1993, now abandoned.

BACKGROUND OF THE INVENTION

1. Field of the Invention

The present invention relates to a pen, such as a fountain pen, a ball-point pen or the like, and more particularly to a combined lighter and pen, that is, a pen used as a lighter.

2. Description of the Prior Art

Conventionally, a pen and a lighter are separately manufactured and separately used. Thus, they must be carried separately, thus resulting in an inconvenience, such as separately finding them whenever it is required to use them. Particularly, the lighter as well as the pen is likely to be lost and this often causes the user inconvenience in use exclusive of a financial loss.

In addition, the known lighter is not provided with means for protecting a flame which is projected from a flame nozzle of the upper section of the lighter. Thus, the flame of the lighter is influenced by circumstances, for example, a wind, such that the flame violently sways even in a breeze, and furthermore, it may extinguish so as not to achieve its specific object for lighting a cigarette.

SUMMARY OF THE INVENTION

It is, therefore, an object of the present invention to provide a combined lighter and pen in which the aforementioned problems caused by the lighter and the pen, separately manufactured and separately used, can be overcome and which comprises a pen part and a lighter part which are detachably engaged with each other such that they are used either while assembled or separated.

It is another object of the present invention to provide a combined lighter and pen which is provided with a removable metal net covering a gas nozzle as well as an ignition device of a lighter part, thereby protecting the flame projected from the gas nozzle and adding to the beauty of the combined lighter and pen.

To accomplish the above objects, a combined lighter and pen in accordance with a preferred embodiment of this invention comprises: a pen part having a threaded top section; and a lighter part detachably engaging with the pen part, the lighter part comprising: a gas container provided at its upper end with an ignition device as well as a gas nozzle, the ignition device having an ignition switch, and the gas nozzle having a nozzle control piece for selectively opening the nozzle, the gas container having a threaded engagement section downwardly extending from a bottom of the gas container, the threaded engagement section detachably engaging with the threaded top section of the pen part; a hollow outer casing for receiving the gas container, the outer casing having an outer threaded upper end and a side opening, the side opening movably receiving an operating piece; an inner threaded upper cap engaging with the outer threaded upper end of the outer casing; a metal net mounted on the inner threaded upper cap, the metal net being heated by a flame projected from the gas nozzle; an operating piece movably received by the side opening of the outer casing such that its pressing part is rested on a side section of the nozzle control piece and comes into close contact with a top end of the ignition switch of the ignition device, thereby pressing down the nozzle control piece as well as the ignition switch when pressed down, the operating piece having a clip engaging hole; and a clip engaging with the operating piece to support the movable position of the operating piece in the side opening of the outer casing and to clip the combined lighter and pen, the clip having an insert part inserted in the clip engaging hole of the operating piece.

BRIEF DESCRIPTION OF THE DRAWINGS

The above and other objects, features and other advantages of the present invention will be more clearly understood from the following detailed description taken in conjunction with the accompanying drawings, in which:

FIGS. 2A to 2C are partial sectional views of the combined lighter and ball-point pen of FIG. 1, respectively, in which:

FIG. 2A shows the combined lighter and ball-point pen when a ball-point part is separated from a lighter part;

FIG. 2B shows the combined lighter and ball-point pen when used with an upper cap provided with a metal net; and FIG. 2C shows the combined lighter and ball-point pen when used without the upper cap.

DESCRIPTION OF THE PREFERRED EMBODIMENT

As well known to those skilled in the art, there are a variety of pens, such as a ball-point pen, a sharp pencil, a fountain pen and the like. However, for convenience, the present invention will be adapted to a ball-point pen in a preferred embodiment.

Figure 1:
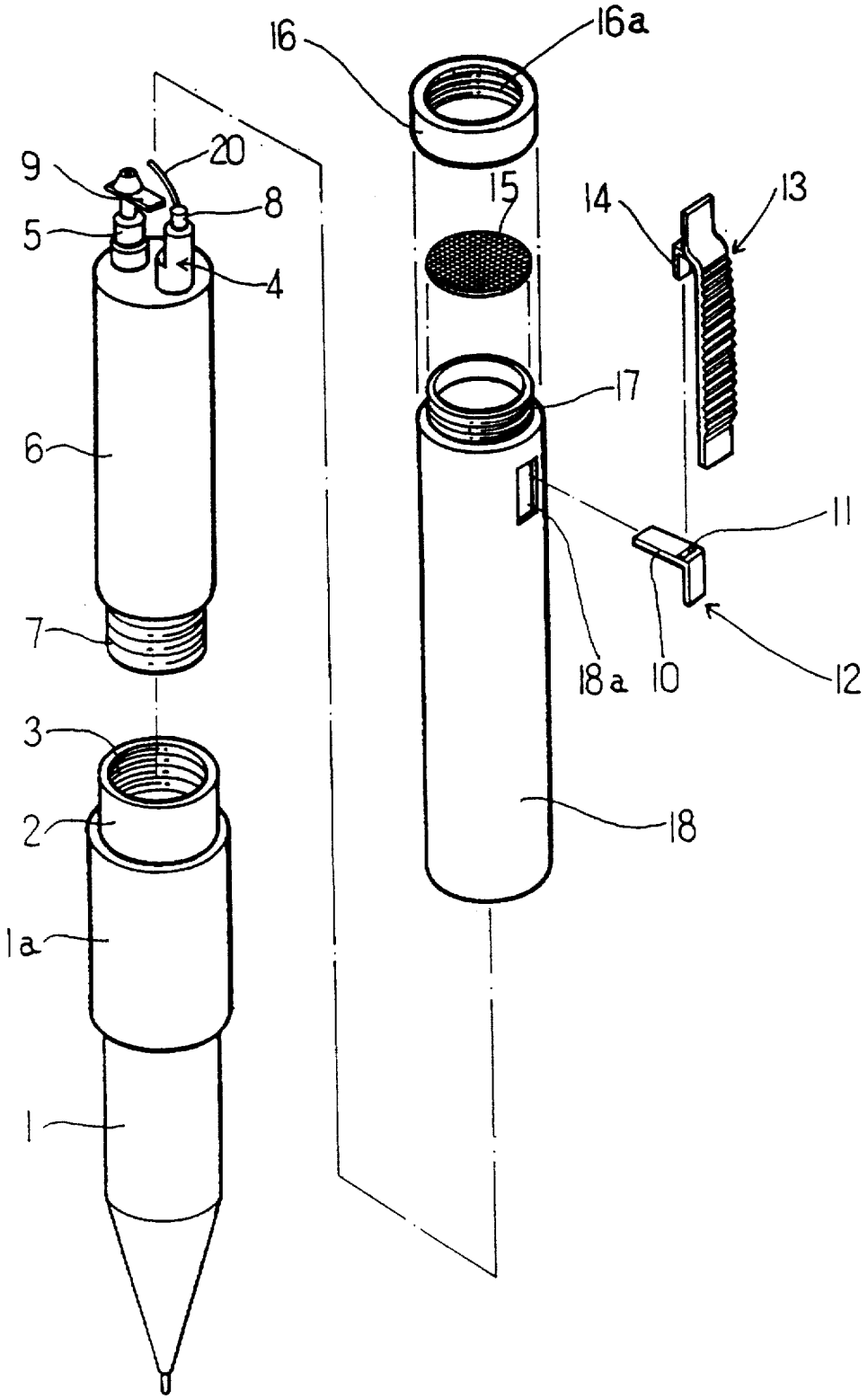
FIG. 1 is an exploded perspective view of a combined lighter and ball-point pen in accordance with a preferred embodiment of the present invention.
Figure 2A:
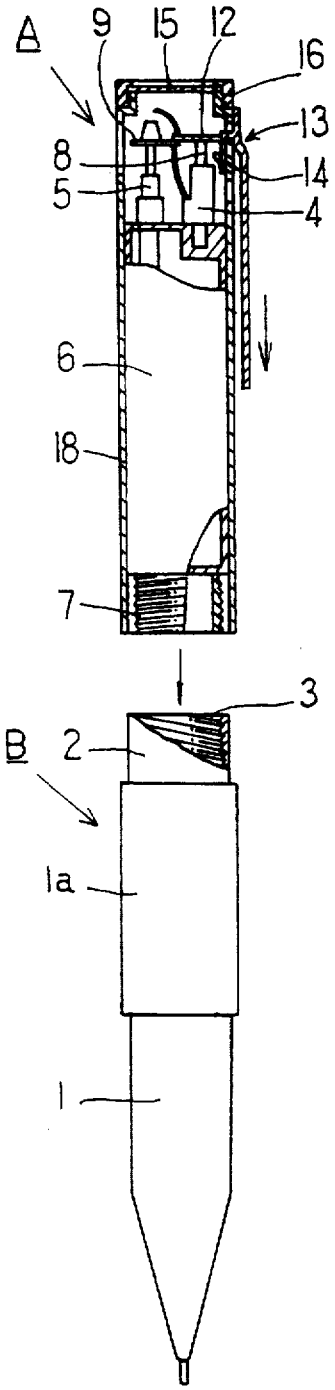
Figure 2B:
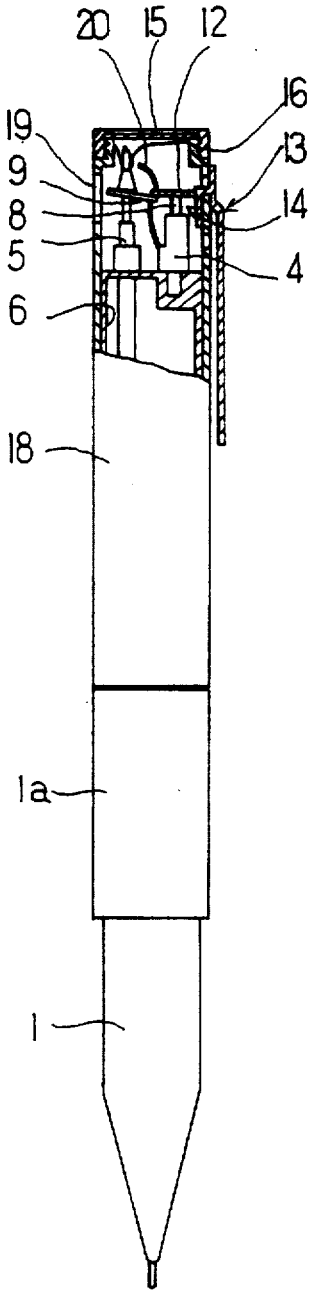
Figure 2C:
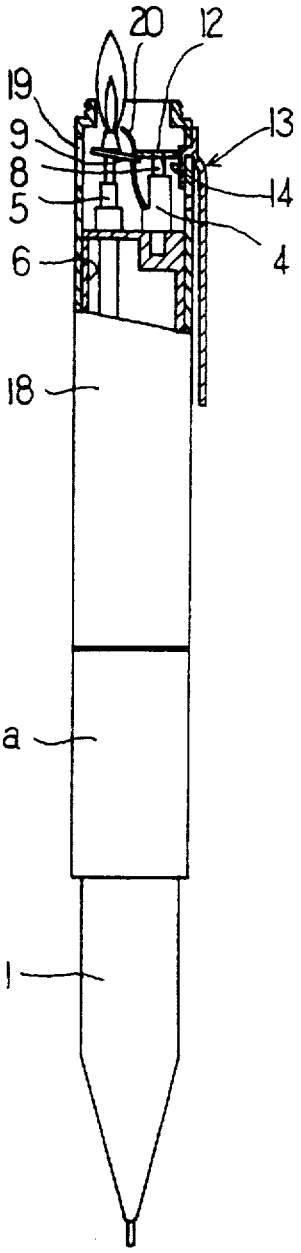

With reference to the drawings, FIG. 1 shows an exploded perspective view of a combined lighter and ball-point pen in accordance with a preferred embodiment of the present invention, and FIGS. 2A to 2C show in partial sectional views the combined lighter and ball-point pen of FIG. 1. The combined lighter and ball-point pen (hereinafter, referred to simply as "the lighter ball-point") comprises a ball-point part B and a lighter part A which are combined with each other such that they are separable from each other as needed. The ball-point part B is constructed in the form of a hollow pipe having a cylindrical top section 2 provided with female threads 3 on an inner surface thereof. The lighter part A comprises a gas container 6 of which the upper end is provided with an ignition device 4 as well as a gas nozzle 5 neighboring the ignition device 4. The ignition device 4 is provided with an ignition switch 8. The gas nozzle 5 causes the gas to be selectively projected out of the gas container 6 in a conventional manner. In order to achieve the selective projection of gas from the gas nozzle 5, the gas nozzle 5 is provided with a nozzle control piece 9 for selectively opening the nozzle 5 when imparted with an outside force as will be described later herein. The bottom of the container 6 is provided with a gas injection port (not shown) and a flame controller (not shown), such as a screw type flame controller.

In order to bring this lighter part A into engagement with the ball-point part B, an outer threaded engagement cylinder 7 extends downwardly from the bottom of the container 6 so as to engage with the inner threaded top section 2 of the ball-point part B. The gas container 6 is encased by a cylindrical outer casing 18 of which the upper end 17 is externally threaded. This externally threaded upper end 17 detachably engages with an internally threaded upper cap 16 to which a metal net 15 made of a predetermined metal is removably mounted. The upper cap 16 is constructed in the form of a ring having female threads 16*a*. The outer casing 18 also has a rectangular opening 18*a* at its side wall so as to receive a reversed L-shaped operating piece 12. This operating piece 12 is movably received by the rectangular opening 18*a* such that the distal end of a pressing part 10 of the operating piece 12 is rested on a side of the nozzle control piece 9, and the lower surface of the pressing part 10 comes into close contact with the top end of the ignition switch 8 of the ignition device 4. The movable position of the operating piece 12 in the opening 18*a* is supported by a clip 13. In order to achieve this object, the clip 13 is provided with an insert part 14 while this operating piece 12 has a clip engaging hole 11 for receiving the insert part 14 of the clip 13.

In the drawings, the reference numerals 1, 1*a*, 19 and 20 denote a main body of the ball-point part B, a finger holder, an air inlet and a spark generator, respectively.

The ball-point unit of the lighter ball-point of this invention may be constructed in a conventional manner. In a preferred embodiment of this invention, the ball-point unit cooperates with the finger holder 1*a* in such a manner that a ball-point core (not shown) appears or disappears by repeatedly pressing down the finger holder 1*a* while gripping the main body 1 of the ball-point part B. Otherwise stated, when the finger holder 1*a* is pressed down once, the ball-point core appears, however, when the casing 18 or the holder 1*a* is pressed down once more again, the core disappears. In the present invention, since the lower end of the outer casing 18 of the lighter part A comes into direct contact with the upper end of the finger holder 1*a* of the ball-point part B when the engagement of the externally threaded cylinder 7 with the internally threaded top section 2 is achieved as shown in FIGS. 2B and 2C, the pressing down operation of the outer casing 18 with respect to the main body 1 yields the same result as when the finger holder 1*a* of the ball-point part B is pressed down.

When the lighter ball-point is used as a lighter, the clip 13 of which the insert part 14 is inserted in the clip engaging hole 11 of the operating piece 12 is pressed down as shown at the arrow of FIG. 2A. Thus, simultaneously with pressing down the ignition switch 8 of the ignition device 4 so as to generate a spark from the spark generator 20, the pressing part 10 of the operating piece 12 presses down the nozzle control piece 9 of the gas nozzle 5. The gas is thus projected from the gas nozzle 5 and ignited by the spark of the spark generator 20. Here, since the gas nozzle 5 is covered with the metal net 15 supported by the upper cap 16, the flame resulting from the ignition of the gas does not extend out of the upper cap 16 but heats the metal net 15. In this case, the lighter part A of the lighter ball-point of this invention is used as a flameless lighter as shown in FIG. 2B. In this regard, the lighter of this invention is not influenced by circumstances, such as a wind, and reliably lights a cigarette. The metal net 15 covering the gas nozzle 5 as well as the ignition device 4 adds to the beauty of the lighter.

Of course, it may be required to use the lighter ball-point of the present invention as a conventional flame lighter, such as for lighting a burner. This is achieved by simply removing the upper cap 16 provided with the metal net 15 from the outer casing 18 as shown in FIG. 2C. Since the metal net 15 is detachably supported by the upper cap 16, it is easily substituted with new one, such as when it is broken, thus being economical.

To recharge the gas into the gas container 6 or to control the intensity of the flame, the lighter part A is simply separated from the ball-point part B. In order to separate the lighter part A from the ball-point part B, the main body 1 of the ball-point part B is rotated with respect to the lighter part A so as to disengage the internally threaded top section 2 of the ball-point part B from the externally threaded cylinder 7 of the lighter part A. In addition, since the lighter part A is separated from the ball-point part B as required previously, the lighter ball-point of the present invention can be used while being separated into two parts A and B. The lighter ball-point of this invention is provided with the clip 13 which supports the movable position of the operating piece 12 and positions the lighter ball-point in a place, such as at a state of clipping on a pocket, thereby achieving the desired convenience in use and preventing loss thereof.

In the above description, the lighter of this invention has been disclosed as having an electronic ignition device, however, it should be understood that there exist a variety of types of ignition devices, such as an ignition device using a lighter flint or an atomic ignition device, which yields the same result as described for the preferred embodiment without affecting the functioning of this invention.

As described above, the present invention provides a combined lighter and pen comprising a pen part and a lighter part which are combined with each other such that they are separable from each other as required. Thus, the combined lighter and pen is convenient to use. The lighter part is provided with a metal net covering a gas nozzle as well as an ignition device to be heated by the flame, so that the combined lighter and pen of this invention can be used as a flameless lighter. The metal net is detachably mounted on the upper cap of the lighter part. Hence, the metal net is easily substituted with a new one, such as when it is broken. In addition, the pen part of the combined lighter and pen is recharged with a new ball-point core of a new pencil lead as required. Thus, the combined lighter and pen of this invention can be semipermanently used and is economical.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. A combined lighter and writing implement comprising:

a writing part having an internally threaded top section; and a lighter part, said lighter part including a gas container provided at its upper end with an ignition device and a gas nozzle, the ignition device having an ignition switch, and the gas nozzle having a nozzle control piece for selectively opening the gas nozzle, said gas container having an externally threaded engagement section extending downwardly from a lower end of said gas container, the externally threaded engagement section detachably engaging with the internally threaded top section of said writing part, a hollow outer casing for receiving said gas container, said hollow outer casing having an externally threaded upper end and a side opening, the side opening movably receiving an operating piece therein, an internally threaded upper cap engageable with the externally threaded upper end of said hollow outer casing, a metal net mounted on the internally threaded upper cap, said metal net being heated by a flame projecting from the gas nozzle;

the operating piece being movably received by the side opening of said hollow outer casing such that a pressing part of the operating piece rests on a side section of the nozzle control piece and comes into close contact with a top end of the ignition switch of the ignition device, thereby pressing the nozzle control piece and the ignition switch down when the operating piece is pressed down, said operating piece having a clip engaging hole, and a clip engaging with the operating piece to support the movable position of the operating piece in the side opening of said hollow outer casing, said clip having an insert part inserted in the clip engaging hole of the operating piece, said writing part and said lighter part detachably engaging with each other for separate use as a writing implement or lighter.

2. The combined lighter and writing implement according to claim 1, wherein said writing part is a ball-point pen.

3. The combined lighter and writing implement according to claim 1, wherein said writing part is a sharp pencil.

4. The combined lighter and writing implement according to claim 1, wherein said writing part is a fountain pen.

5. The combined lighter and writing implement according to claim 1, wherein said ignition device is an electronic type ignition device.

6. The combined lighter and writing implement according to claim 1, wherein said ignition device uses a lighter flint.

7. The combined lighter and writing implement according to claim 1, wherein said upper cap detachably engages with said outer casing and said metal net is detachably mounted on said upper cap.

* * * * *